United States Patent [19]

Yaegashi et al.

[11] 4,365,856

[45] Dec. 28, 1982

[54] ELECTRIC CONNECTOR FOR COAXIAL RIBBON CABLE

[75] Inventors: Hirokatsu Yaegashi; Shinichi Watanabe, both of Ohsaki, Japan

[73] Assignee: Hirose Electric Co., Ltd., Tokyo, Japan

[21] Appl. No.: 166,993

[22] Filed: Jul. 9, 1980

[51] Int. Cl.[3] ..... H01R 4/66

[52] U.S. Cl. ..... 339/14 R; 339/17 F; 339/97 P; 339/176 MF

[58] Field of Search ..... 339/14 R, 17 F, 176 MF, 339/97 P, 133 M

[56] References Cited

U.S. PATENT DOCUMENTS

| | | | |
|---|---|---|---|
| 3,509,513 | 4/1970 | Russin | 339/14 R |
| 4,260,209 | 4/1981 | Zell et al. | 339/17 F X |
| 4,310,208 | 1/1982 | Webster et al. | 339/14 R |

*Primary Examiner*—Eugene F. Desmond

*Attorney, Agent, or Firm*—Brumbaugh, Graves, Donohue & Raymond

[57] ABSTRACT

An electric connector for coaxial ribbon cable comprises a guide block for positioning one end of a coaxial ribbon cable to be connected, a cable clamp coupled to the guide block for clamping the coaxial ribbon cable and a housing having the body of a ground contact disposed in the center thereof, and at least one signal contact disposed therein at either sides of the body of the ground contact. The ground contact is provided with any number of contacting sections. These contacting sections are located in the housing in the same line as the signal contacts are arranged. In connecting a coaxial ribbon cable to the electric connector, the top ends of the ground contact and the signal contacts can be connected to the outer conductors and the inner conductors respectively, of one end of the coaxial ribbon cable as positioned in the guide block.

5 Claims, 15 Drawing Figures

ELECTRIC CONNECTOR FOR COAXIAL RIBBON CABLE

BACKGROUND OF THE INVENTION

1. Field of the Invention

This invention relates to an electric connector for connecting as coaxial ribbon cable.

2. Description of the Prior Art

Recently, the propagation speeds of integrated circuits used in computer circuit systems have become higher and higher. Therefore, in transmitting a signal between circuit boards or assemblies, coaxial cables have been more frequently used for the purpose of minimizing incoming noises or crosstalks. Heretofore, connection of such a coaxial cable to a circuit board was effected by individually soldering the center conductor and the ground conductor of the coaxial cable to the corresponding terminals fixed to the circuit board. This was a time-consuming and costly operation. However, in order to avoid such an operation, an expensive coaxial connector must have been used. On the other hand, recently, as a countermeasure to high density package due to increase in the number of signals appearing in circuit systems, a coaxial ribbon cable has been developed for use in interconnecting the circuit systems. One type coaxial ribbon cable comprises a common outer jacket and a plurality of coaxial cables arranged in parallel to one another within the jacket. Another type coaxial ribbon cable comprises a plurality of single coaxial cables adhered together parallel to one another. Each of the coaxial cables has a center conductor for transmitting high speed pulse signals, an outer conductor for shielding the center conductor against external interferences and a dielectric for isolating the center conductor from the outer conductor. The outer conductor may be in the form of a woven metallic wire or a coiled metallic wire or a metallic foil surrounding the dielectric. Electric connectors for connecting such a coaxial ribbon cable have been proposed and used. However, these connectors have the disadvantages that their packaging density is low, they can be used only for certain coaxial ribbon cables, they are not suitable for connecting a small coaxial ribbon cable, they are not economical because the same number of ground terminals as there are signals is required and the high speed transmitting characteristics in the connecting part are unsatisfactory. Moreover, according to a given frequency and noise margin, it is often necessary to selectively change the arranged pattern of ground terminals. However, in the conventional electric connectors, it was difficult to realize such a change of ground pattern.

Therefore, it is an object of this invention to eliminate the above disadvantages and provide an electric connector for coaxial ribbon cable wherein a high density packaging can be realized and the change of ground pattern can be easily effected.

SUMMARY OF THE INVENTION

An electric connector for coaxial ribbon cable according to this invention comprises a guide block for positioning one end of a coaxial ribbon cable to be connected, a cable clamp coupled to the guide block for clamping the coaxial ribbon cable, and a housing having the body of a ground contact disposed in the center thereof. At least one signal contact is disposed therein at either sides of the body of the ground contact, said ground contact being provided with a predetermined number of contacting sections. The contacting sections are located in the same line as said signal contacts are arranged, whereby the top ends of said ground contact and said signal contacts can be connected to the outer conductors and the inner conductors respectively, of one end of said coaxial ribbon cable as positioned in said guide block when said coaxial ribbon cable is connected to said electric connector.

Preferred embodiments of this invention will be described in connection with the accompanying drawings.

DESCRIPTION OF THE PREFERRED EMBODIMENTS

Figure 1:
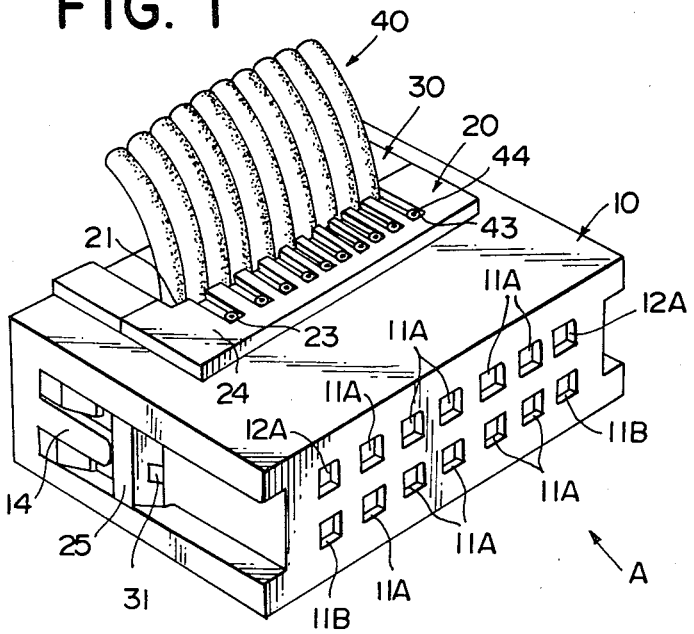
FIG. 1 is a perspective view of an embodiment of an electric connector according to this invention terminated to a coaxial ribbon cable.

Referring now to FIG. 1, there is shown an electric connector for coaxial ribbon cable comprising a housing 10 in which signal contacts and a ground contact are arranged, a guide block 20 about which one end of a coaxial ribbon cable 40 to be terminated is wrapped and positioned and a cable clamp 30 coupled to the guide block 20 for fixing the one end of the coaxial ribbon cable. The housing 10 may be made of an insulating material, such as plastic, and is provided at its forward end with signal contact receiving apertures 11A for accommodating signal contacts which may make contact with the corresponding signal contacts of a mating connector, and ground contact receiving apertures 12A for receiving the ground contacts of the mating connector as arrayed in two rows. In this embodiment, apertures 11B are not in use and remain empty.

These apertures will be described in further detail hereinafter.

Figure 2:
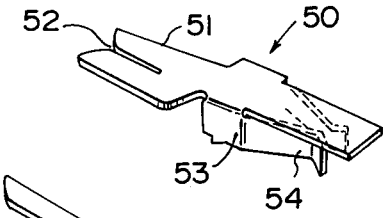
FIG. 2 is a perspective view of a signal contact as used in the electric connector of FIG. 1.
Figure 7:
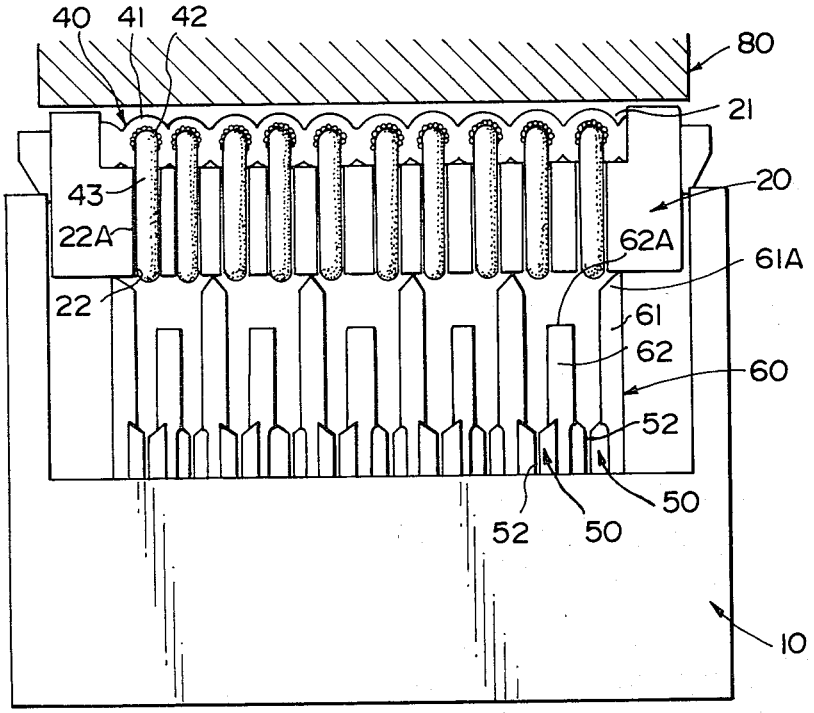
FIG. 7 is a front view of the housing and the guide block of the electric connector of FIG. 1 being ready to be assembled together.

FIG. 2 illustrates an example of a signal contact adapted to be disposed in the signal contact receiving apertures 11A of the housing. The signal contact 50 may be integrally formed of a resilient and conductive sheet material and has a terminating section 51 having a wire receiving slot 52 for terminating one of the center conductors of the coaxial ribbon cable at one end thereof, an anchoring section 53 for engaging the inner wall of the aperture of the housing 10 to securing the contact 50 in place within the aperture at the intermediate portion thereof, and a cantilever contact spring section 54 for receiving and making electrical contact with the signal contact of a mating connector which will be inserted through the aperture 11A at the other end thereof. The wire receiving slot 52 is preferably provided in a position shifted by a half of the pitch of a coaxial ribbon cable to be connected from the center line of the cantilever contact spring section 54. This will make it possible to position the wire receiving slots 52 of the signal contacts 50 in a staggered arrangement so that the pitch of the wire receiving slots 52 arranged may be equal to the pitch of the center conductors of the coaxial ribbon cable, as best shown in FIG. 7, by arranging the signal contacts 50 in the apertures of the housing 10 in one row in an orientation opposite to that of the signal contacts 50 arranged in the apertures in the other row.

Figure 3:
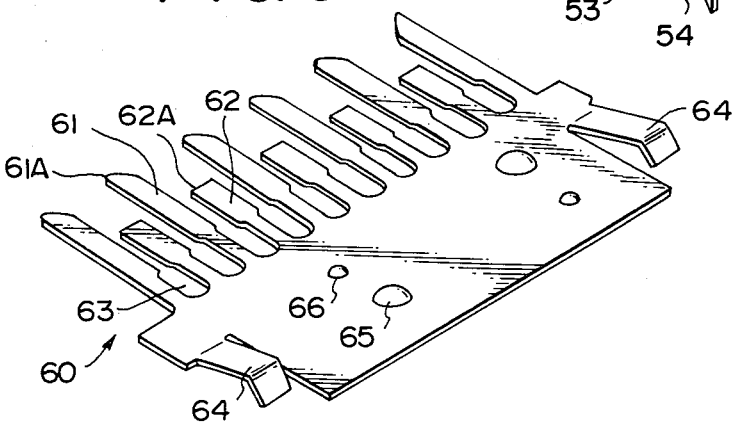
FIG. 3 is a perspective view of a ground contact as used in the electric connector of FIG. 1.

FIG. 3 illustrates an example of ground contact as disposed in the ground contact slot 13 of the housing 10. The ground contact 60 may be integrally formed of a resilient and conductive sheet material and has a plurality of legs for electrically terminating to the outer conductors of the coaxial ribbon cable at one end thereof. These legs comprises long legs 61 and short legs 62 alternately arranged. The top ends 61A of the long legs 61 are tapered, and the top ends 62A of the short legs 62 are flat. The roots of these legs are notched to provide enlarged openings 63. The width of the openings 63 is preferably slightly larger than the outer diameter of the inner dielectric of the coaxial ribbon cable, thereby preventing the legs from contacting the inner conductors of the cable. Of course, the pitch of the openings 63 arranged is equal to that of the coaxial ribbon cable. The ground contact 60 is provided at the other end with contacting sections 64 for receiving and making electrical contact with the ground contacts of a mating connector which will be inserted through the apertures 12A of the housing 10. Moreover, the ground contact 60 is preferably provided with projections 65 and 66 for engaging the wall of the slot of the housing 10 to firmly secure the ground contact 60 within the slot of the housing 10.

The guide block 20 may be formed of an insulating material such as plastic. The guide block 20 is provided in the top surface with a recess 21 for receiving and positioning one end of a coaxial ribbon cable to be terminated (see FIGS. 1 and 7 to 10). The guide block 20 is provided in the bottom surface with grooves 22 for receiving and positioning each of the inner conductors with the inner dielectrics of the coaxial ribbon cable (see FIGS. 7 to 10). Furthermore, the guide block 20 is provided on one side with grooves 22A for receiving and positioning the exposed inner dielectric with the inner conductors of the coaxial ribbon cable, which grooves 22A extend from the grooves 22 in the bottom surface to the recess 21 in the top surface of the block 20 (see FIGS. 7 to 10). The pitches of the grooves 22 and 22A are made equal to that of the coaxial cables within the coaxial ribbon cable. In addition, the guide block 20 has a recess (not shown) formed in the bottom surface thereof, which recess is for receiving the top ends of the press contact connecting parts 51 of the signal contacts 50 disposed in the housing 10. Moreover, the guide block 20 is provided with a slot (not shown) extending from the center of the recess to the top surface of the guide block, which slot is for receiving the long and short legs 61 and 62 of the ground contact 60. To facilitate receiving of the long and short legs 61 and 62 of the ground contact 60, the slot is preferably shaped so that the width of the slot is largest on the receiving end for the long and short legs 61 and 62 and smaller in a position more distant from the receiving end. Moreover, the guide block 20 is provided at the other side with an arch part 24 forming arched openings 23 for receiving the inner dielectrics with the inner conductors of the coaxial ribbon cable, thereby preventing the inner dielectrics from getting out of position (see FIG. 1).

The cable clamp 30 may be formed of an insulating material such as plastic. The cable clamp 30 is provided in its bottom surface with a recess (not shown) for receiving the top ends of the long legs 61 of the ground contact 60 disposed in the housing 10.

How to connect a coaxial cable to the electric connector described above will be described in detail.

Figure 4:
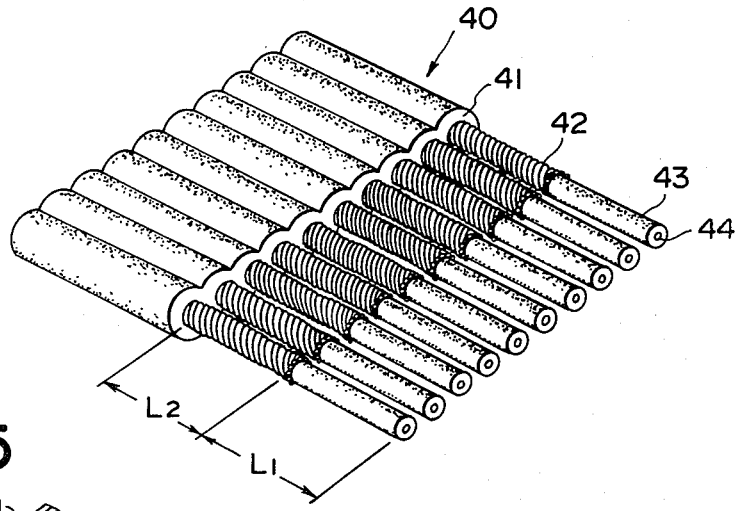
FIG. 4 is a perspective view of one end of a coaxial ribbon cable prepared to be terminated to the electric connector.
Figure 9:
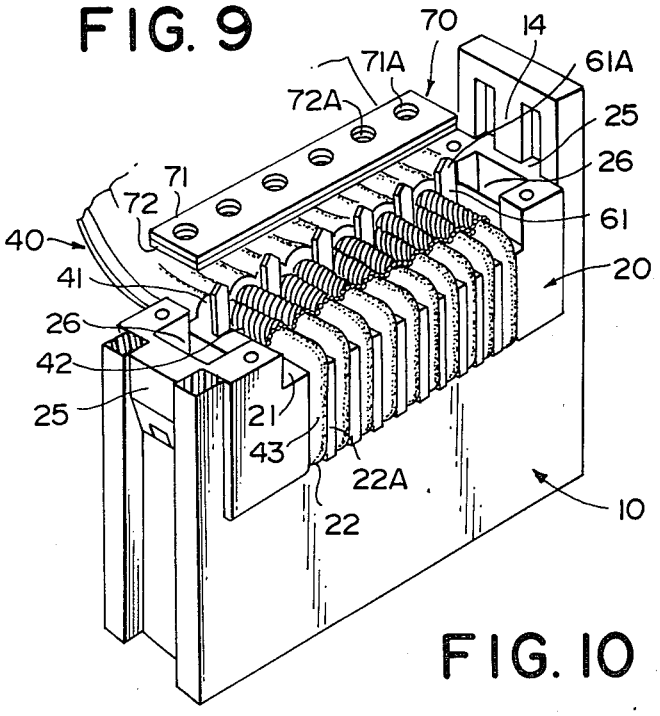
FIG. 9 is a partially cut-away perspective view of the electric connector of FIG. 1 in which the outer conductors of the cable are prepared to be soldered to the ground contact.

Firstly, as shown in FIG. 4, one end of a coaxial ribbon cable 40 to be terminated is processed so that a predetermined length $L_1$ of the outer jacket 41 and the outer conductors 42 as used for ground lines of the coaxial ribbon cable 40 is stripped off, separating the inner conductors 44 as used for signal lines with the inner dielectrics 43 and then a predetermined further length $L_2$ of the outer jacket 41 is stripped off to expose the outer conductors 42. Secondly, as best shown in FIGS. 7 and 9, the one end of the coaxial ribbon cable 40 thus processed is wrapped about the guide block 20 so that the exposed outer conductors 42 are positioned in the recess 21 on the top surface of the guide block 20 and the separated inner conductors 44 with the inner dielectrics 43 are positioned in the grooves 22A in the side and the grooves 22 in the bottom surface of the guide block 20. In this case, the forward ends of the inner conductors 44 with the inner dielectrics 43 are inserted into the arched openings 23 of the arch part 24 of the guide block 20 to prevent them from getting out of position, as shown in FIG. 1.

Figure 6:
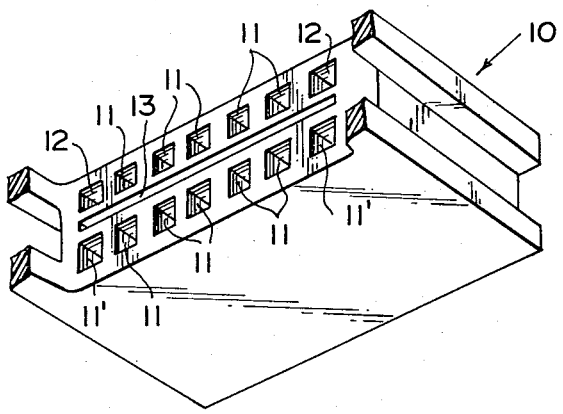
FIG. 6 is a partially cut-away perspective view of the housing of the electric connector of FIG. 1.

The apertures for each contact of the housing 10 will be described in further detail in connection with FIG. 6, which is a partially cut-away perspective view of the housing 10. The housing 10 is provided with a plurality of signal contact apertures 11 for accommodating each signal contact 50 arranged in two rows. These apertures 11 communicate with the respective signal contact receiving apertures 11A as described above in connection with FIG. 1. Furthermore, the housing 10 has contacting section receiving apertures 12 for accommodating the contacting parts 64 of the ground contact 60 aligned with one row of the apertures 11. These apertures 12 communicate with the respective ground contact receiving apertures 12A as described above in connection with FIG. 1. Moreover, the housing 10 is provided with a ground contact slot 13 extending through the central part thereof to interconnect the contacting section receiving apertures 12. The ground contact slot 13 is for receiving the body of the ground contact 60 having the projections 65 and 66 (see FIG. 3). In this embodiment, the housing 10 also has apertures 11' formed therein. The apertures 11' communicate with the respective apertures 11B as described above in connection with FIG. 1. However, the apertures 11' will not be in use, remaining empty.

AS shown in FIG. 7, then the signal contacts 50 as shown in FIG. 2 are inserted into the respective signal contact apertures 11 of the housing 10 and the ground contact 60 as shown in FIG. 3 is inserted into the contacting section receiving apertures 12 and the ground contact slot 13 of the housing 10. The guide block 20 about which the one end of the coaxial ribbon cable 40 has been wrapped as described before is coupled to the housing 10 wherein the contacts have been disposed as described above in the following manner.

Figure 8:
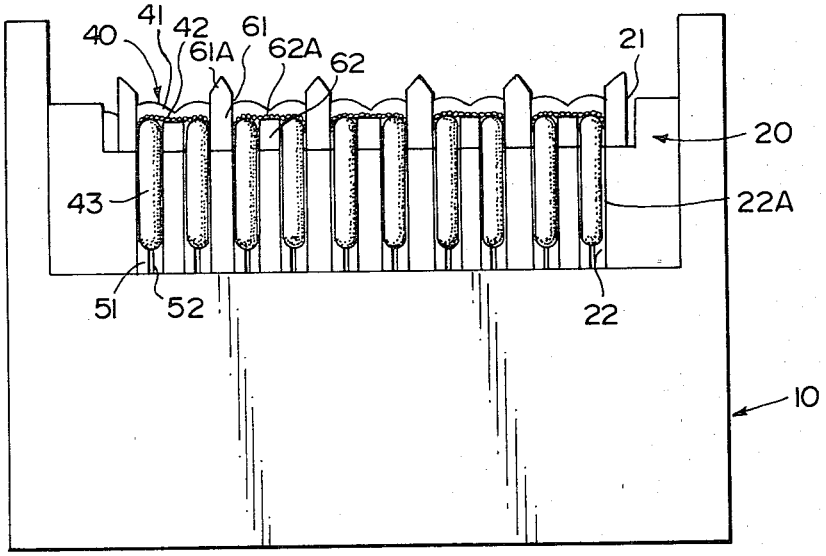
FIG. 8 is a front view of the housing and the guide block of the electric connector of FIG. 1 after assembly.

As shown in FIG. 7, by means of a suitable backing up tool 80 abutting the top surface of the guide block 20, the guide block 20 is pressed to the housing 10. Then, the top ends of the long legs 61 of the ground contact 60 pass through the recess of the guide block 20 and between the adjacent exposed outer conductors 42 of the coaxial ribbon cable 40 to project from the outer jacket 41. The top ends 62A of the short legs 62 of the ground contact 60 pass through the recess of the guide block 20 to push up the peripheries of the exposed outer conductors 42 of the coaxial ribbon cable 40. This is shown in FIG. 8. Simultaneously, the separated inner conductors 44 with the inner dielectrics 43 of the coaxial ribbon cable are press fitted into the wire receiving slots 52 of the terminating sections 51 of the signal contacts 50 to thereby effect press contact connecting of the inner conductors 44 with the signal contacts 50.

A solder plate as used for reinforcing the electric contact of the ground contact 60 with the other conductors 42 of the coaxial ribbon cable 40 will be described in connection with FIG. 5, which illustrates an example of the solder plate. The solder plate 70 comprises a supporting plate 71 and a solder tape 72. The supporting plate 71 may be made of a metallic sheet. The supporting plate 71 and the solder tape 72 may be separated or the solder tape 72 may be adhered to the supporting plate 71. The supporting plate 71 and solder tape 72 have through-holes 71A and 72A respectively, for permitting the top ends 61A of the long legs 61 of the ground contact 60 to pass therethrough. The through-holes are preferably positioned out of the center line of the plate 70, thereby leaving an area of the plate 70 against which a suitable heating plate is permitted to abut. Preferably, the solder tape 72 contains a flux.

Figure 5:
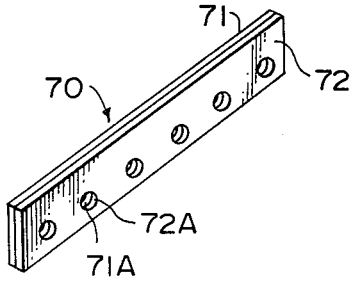
FIG. 5 is a perspective view of a solder plate as used for connection of the electric connector of FIG. 1.
Figure 10:
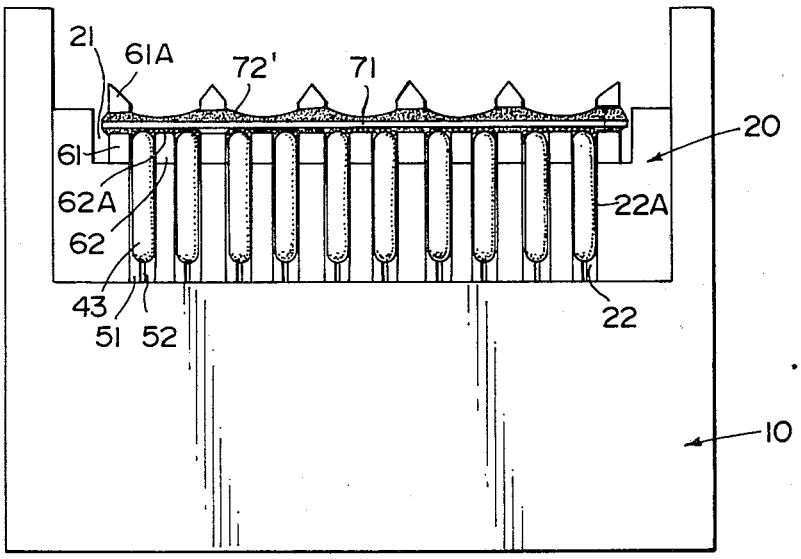
FIG. 10 is a front view of the electric connector of FIG. 1 after soldering the outer conductors of the cable to the ground contact.

As shown in FIG. 9, the solder plate 70 as shown in FIG. 5 is placed on the top surface of the guide block 20 coupled to the housing 10 so that the top ends 61A of the long legs 61 of the ground contact 60 projecting from between the adjacent exposed outer conductors 42 of the coaxial ribbon cable 40 wrapped about the guide block 20 pass through the holes 71A and 72A of the solder plate 70, with the solder tape 72 contacting the outer conductors 42. Under this condition, a suitable heating plate (not shown) is placed over the supporting plate 71 of the solder plate 70 and on the top ends 61A of the long legs 61 of the ground contact 60 projecting from the solder plate 70 to heat them. Then, the solder tape 72 is melted and flows over the outer conductors 42 of the coaxial ribbon cable, the supporting plate 71 of the solder plate and the top ends 61A of the long legs 61 and the top ends 62A of the short legs 62 of the ground contact 60, thereby resulting in close soldering among them and thus a reinforced electric contact of the outer conductors 42 of the coaxial ribbon cable with the ground contact 60. This is shown in FIG. 10, wherein reference numeral 72' indicates a fused solder. The cable clamp 30 is then coupled to the assembly of the guide block 20, the housing 10 and the coaxial ribbon cable 40 shown in FIG. 10 to complete the connection of the coaxial ribbon cable 40 with the electric connector as shown in FIG. 1. The coupling of the guide block 20 to the housing 10 is locked by the engagement of latching torques 14 provided at both sides of the housing 10 with the upper surfaces of projections 25 on both sides of the guide block 20, as shown in FIG. 1, and the coupling of the cable clamp 30 to the guide block 20 is locked by latching legs 31 provided at both sides of the cable clamp 30 which legs 31 are inserted into through-apertures 26 (see FIG. 9) provided at both sides of the guide block 20 to engage with the lower ends of the projections 25 of the guide block 20, as shown in FIG. 1.

Figure 11:
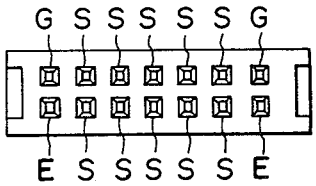
FIG. 11 is an end view of the electric connector of FIG. 1, as viewed from the direction of arrow A in FIG. 1, showing the arrangement of the signal contact receiving apertures and the ground contact receiving apertures of the electric connector.

To more clearly show the arrangement of the signal contact receiving apertures and the ground contact receiving apertures of the electric connector as described above, the end of the electric connector as viewed from the direction of arrow A in FIG. 1 is shown in FIG. 11, wherein reference character S indicates signal contact receiving apertures, reference character G indicates ground contact receiving apertures and reference character E indicates apertures not in use, being empty.

Figure 12A:
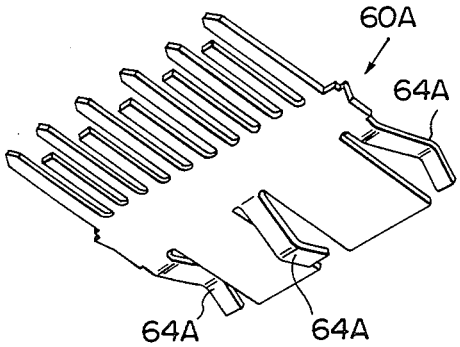
FIGS. 12A and 12B are perspective views of different embodiments of ground contacts.
Figure 12B:
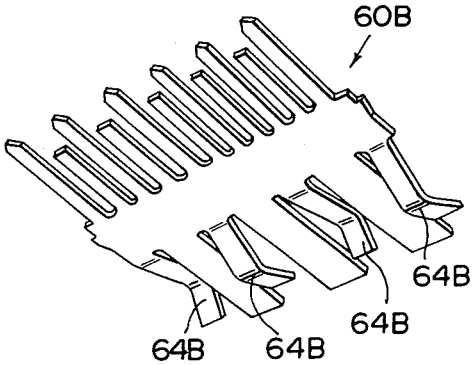
Figure 13A:
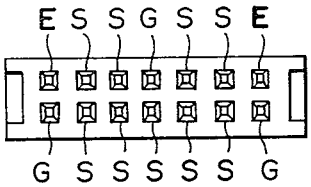
FIGS. 13A and 13B are end views of electric connectors utilizing the respective ground contacts of FIGS. 12A and 12B similar to that of FIG. 11.
Figure 13B:
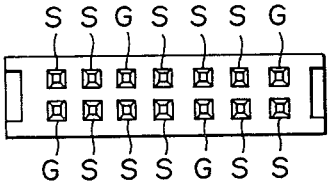

FIGS. 12A and 12B illustrate different ground contacts which can be substituted for the ground contact 60 as shown in FIG. 3 to provide different ground patterns. The ground contact 60A as shown in FIG. 12A has three contacting sections 64A. By utilizing the ground contact 60A and modifying the housing 10 accordingly, an electric connector having an arrangement of signal contact receiving apertures and ground contact receiving apertures as shown in FIG. 13A can be obtained. Similarly, a ground contact 60B as shown in FIG. 12B can provide a different ground pattern. The ground contact 60B has four contacting parts 64B. By utilizing the ground contact 60B and modifying the housing 10 accordingly, an electric connector having an arrangement of signal contact receiving apertures and ground contact receiving apertures as shown in FIG. 13B can be obtained.

Although in the embodiments as described before the connection of the outer and inner conductors of the coaxial ribbon cable with the ground contact and signal contacts of the electric connector is made by soldering and press contact connecting process, this invention is not limited to such process, but may be applied to electric connectors having other connecting mechanism.

The embodiments of electric connector according to this invention described above provide the following advantages:

(1) Since one end of a coaxial ribbon cable to be connected is wrapped about the guide block so that the electric connection of the signal contacts with the inner conductors of the coaxial cable and the electric connection of the ground contact with the outer conductor of the coaxial cable can be made in two different levels and the signal contacts are arranged in two rows, it is possible to reduce the entire dimensions of the electric connector and to easily perform simultaneous connection of a number of inner and outer conductors. Moreover, since the contacting sections of the ground contact are arranged in the same row as the signal contacts, only two rows of the contact receiving apertures are required. This results in the minimum thickness of the housing, which leads to high density packaging.

(2) Since the body of the ground contact is interposed between the two rows of the signal contacts, it is easy to adjust the impedance. Moreover, by suitably selecting the position and the number of the ground contacting sections (as indicated by reference numerals 64, 64A and 64B in FIG. 3, FIGS. 12A and 12B) with respect to the number of the inner conductors of the coaxial ribbon cable, i.e., the number of signals, a suitable ground pattern can be easily determined so that crosstalk due to feedback current in the electric connector may be prevented.

(3) Since the individually separated outer conductors, i.e., ground lines of the coaxial ribbon cable are commonly connected to the common ground contact of the electric connector, it is possible to reduce the number of grounds to be connected to an external system with respect to the number of signals. This is economical.

(4) Since the grooves and arched openings of the guide block prevent the inner conductors of the coaxial cable from getting out of position upon connecting, current press contact connecting can be carried out.

(5) Since the electric connector can be applied to various coaxial ribbon cables such as a coaxial ribbon cable having a woven shield and a coaxial ribbon cable having a coiled shield, it is universal in this meaning.

We claim:

1. An electric connector for coaxial ribbon cable comprising a guide block for positioning one end of a coaxial ribbon cable to be terminated, a cable clamp coupled to the guide block for clamping the coaxial ribbon cable and a housing having the body of a ground contact disposed in the center thereof and at least one signal contact disposed therein on at least one side of the body of the ground contact, said ground contact being provided with a predetermined number of contacting sections, said contacting sections being located in the same line as said signal contacts are arranged, whereby the top ends of said ground contact and said signal contacts can be terminated to the outer conductors and the inner conductors respectively, of the one end of said coaxial ribbon cable as positioned in said guide block when said coaxial ribbon cable is terminated to said electric connector, said guide block being formed so that the one end of the coaxial ribbon cable is wrapped about the guide block, with the exposed outer conductors of the one end of the coaxial ribbon cable being positioned in the top surface of the guide block and the portion of the one end of the coaxial ribbon cable from which at least the outer conductors are removed being positioned in the bottom surface of the guide block, said top end of said ground contact comprising a plurality of legs extending from said body of said ground contact to about the level of said top surface of said guide block and arranged at the same pitch as that of the coaxial ribbon cable, and said top ends of said signal contacts comprising a terminating section extending to about the level of said bottom surface of said guide block and having a wire receiving slot.

2. An electric connector as claimed in claim 1 wherein said legs comprise alternately arranged long and short legs.

3. An electric connector as claimed in claim 2 wherein enlarged openings are provided in the vicinity of the roots of said long and short legs of said ground contact, the width of said openings being slightly larger than the outer diameter of the inner dielectrics of said coaxial ribbon cable.

4. An electric connector as claimed in claim 3 wherein the top ends of said long legs of said ground contact are tapered and the top ends of said short legs of said ground contact are flat.

5. An electric connector as claimed in claim 2 wherein said wire receiving slot of said signal contact is provided in a position shifted by a half of the pitch of said coaxial ribbon cable from the center line of the contacting section of the signal contact.

* * * * *